United States Patent [19]

Wanat

[11] 3,973,664

[45] Aug. 10, 1976

[54] METHOD AND APPARATUS FOR POSITIONING A WEB IN A PRINTER

[75] Inventor: Robert R. Wanat, Park Ridge, Ill.

[73] Assignee: Teletype Corporation, Skokie, Ill.

[22] Filed: Mar. 27, 1975

[21] Appl. No.: 562,539

[52] U.S. Cl. ..... 197/187; 197/133 R; 197/DIG. 9

[51] Int. Cl.[2] ..... B41J 29/42; B41J 15/00

[58] Field of Search ..... 197/127 R, 133 R, 133 T, 197/133 P, 140, 187, 190, DIG. 9, 189; 116/124 R

[56] References Cited

UNITED STATES PATENTS 2,156,315 5/1939 Sherman et al. ..... 197/133 P 3,292,763 12/1966 Whitehead ..... 197/19 D

*Primary Examiner*—Edgar S. Burr
*Assistant Examiner*—R. E. Suter
*Attorney, Agent, or Firm*—W. K. Serp; J. L. Landis

[57] ABSTRACT

A clip constructed of resilient material slidably engages the door of a paper web drive tractor of a printer. The clip defines two reference edges which are spaced by an amount substantially equivalent to the distance between a type line reference rod and the print line of a print mechanism. The operator aligns a selected type row on the web with the reference rod and slides one reference edge adjacent a mark on the web. The web is moved until the mark is aligned with the other reference edge of the clip and the selected type row is thereby positioned on the print line.

7 Claims, 4 Drawing Figures

METHOD AND APPARATUS FOR POSITIONING A WEB IN A PRINTER

BACKGROUND OF THE INVENTION

This invention generally relates to a method and apparatus for positioning a web in a printer and, more particularly, relates to an apparatus for accurately locating a selected type row on the web with respect to the print line of the print mechanism of the printer.

The rapid growth of data communications systems over the last few years has greatly increased the demand for and availability of high speed alphanumeric printers which type informational data in readable form upon a paper web. A particular form of printer enjoying widespread acceptance is the impact printer wherein a plurality of character dies are conveyed on a continuously moving endless carrier past print hammers. The incoming data information is processed and used to drive the print hammers which force selected type characters against the paper web. A printer utilizing this arrangement is described in U.S. Pat. No. 3,822,641 entitled "Impactor Assembly for Printer" by E. S. Babler issued on July 9, 1974, and U.S. Pat. No. 3,742,848 entitled "Endless Carrier Printer" by F. E. Huntoon et al. issued on July 3, 1973, both references having a common assignee with this application.

A particular inconvenience which an operator experiences when using such impact printers is the difficulty of positioning a selected type row on the web with the print line of the print mechanism. This situation frequently occurs during the preparation of a prepared form whereon information is to be typed at a selected location on the paper web. In such aforementioned printers, the print mechanism is so constructed that the print line is obstructed from the operator's view; the row which is being typed being visible only after the web has advanced. Thus, it is particularly advantageous for such printers to include means for accurately positioning a selected type row on the print line thereof.

The illustrated embodiment is directed to a print line reference clip which allows the operator to accurately position type at a selected location on the paper web even though the print line of the printer is obstructed from the operator's view.

SUMMARY

As shown, the apparatus is adapted for use with a high speed printer for handling and positioning a web with respect to a type mechanism. A first reference means is included which is spaced from the print line of the printer a preselected distance. The apparatus includes means defining a first reference indicia for selective alignment with a reference mark upon the web and means defining a second reference indicia for subsequent alignment with the reference mark. The relative spacing of the first and second indicia is substantially equivalent to the spacing between the first reference means and the print line of the printer.

Additionally, the first and second referencing indicia are defined by a member which is selectively positionable with respect to the first referencing means so as to permit selective alignment with a selected mark upon the web. In the illustrated embodiment, the member is in the form of a selectively positionable clip.

A method is described for positioning a paper web with respect to the print line of a high speed printer and includes the step of positioning the desired type row on the web in alignment with a reference provided by the printer. A first indicia carried on the printer is positioned with respect to a selected mark on the web and thereafter the web is moved until the selected mark on the web is aligned with respect to a second indicia spaced a predetermined distance from the first indicia thereby locating the selected type row at the print line of the printer.

It is a main object of this invention to provide a method and apparatus for positioning a selected type row on a paper web carried in a printer with respect to the print mechanism thereof. Other objects and advantages of the invention will be more readily appreciated after reference to the following description and accompanying drawings wherein:

DETAILED DESCRIPTION

Figure 1:
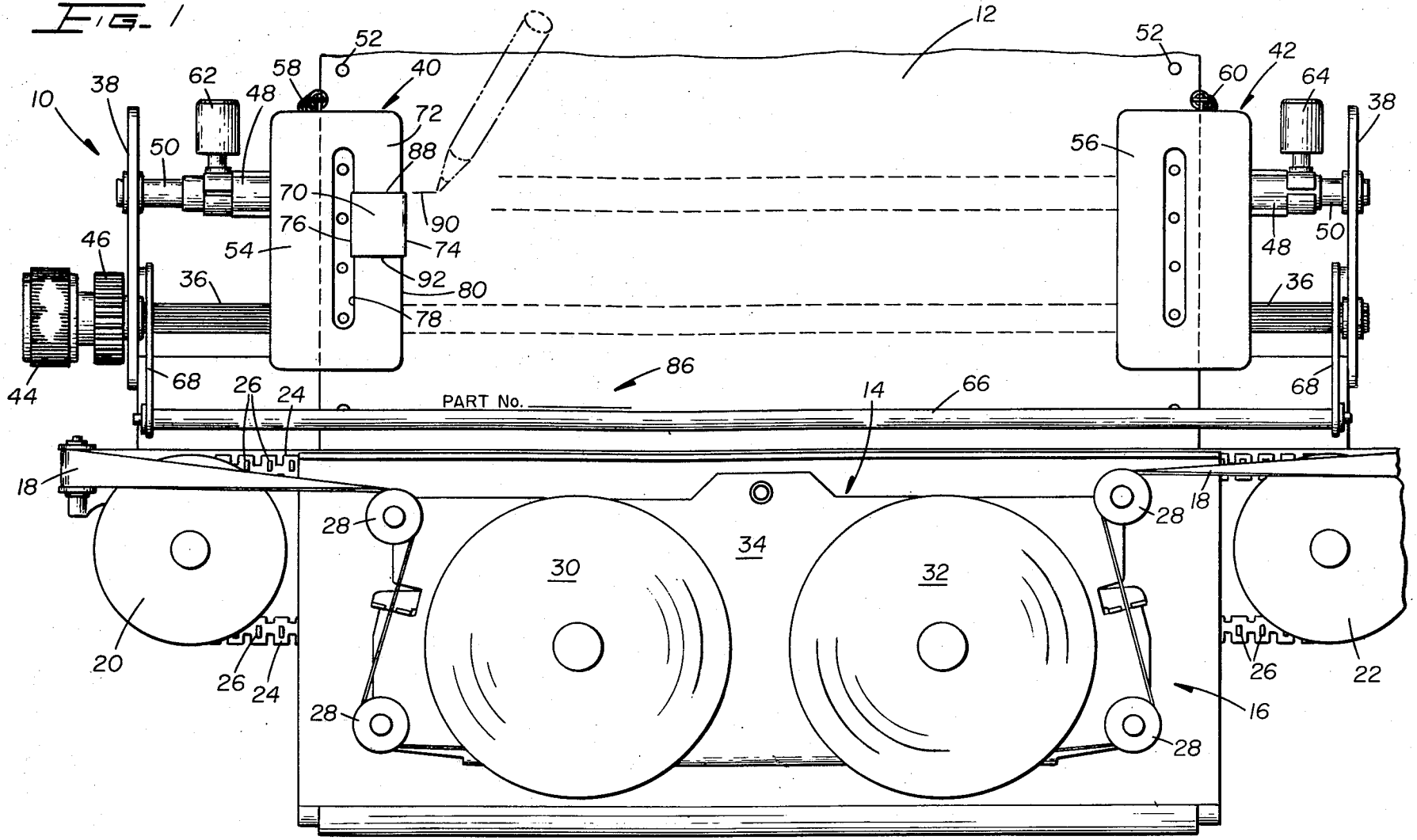
FIG. 1 is a front plan view of an apparatus including certain features of this invention in a first operational mode.

With reference to FIG. 1, the apparatus includes a paper web drive means 10 which draws a continuous web 12 of paper across a print mechanism 14 whereat the information is typed upon the web 12. Additionally, included is a ribbon drive 16 which continually carries a ribbon 18 across the print mechanism 14 thereby presenting successive portions of the ribbon 18. The printing mechanism 14 includes a pair of spaced sprockets 20 and 22 which are pivotably supported to the main frame of the printer and entrained about the sprockets is an endless carrier 24 for translocating a plurality of type dies 26 in a continuous circuitous path. The dies 26 are equally spaced and carried axially on the carrier 24 and the drivers are driven by a motor (not shown). A similar apparatus is described in U.S. Pat. No. 3,822,641, entitled "Impact Assembly for Printers" issued to Egon S. Babler on July 9, 1974, and having a common assignee with this application.

As illustrated, a segment of the ribbon 18 is disposed in a plane substantially parallel to the carrier and between and spaced slightly from the face of the paper web 12 and the dies 26 supported by the carrier 24. The ribbon 18 is entrained about a plurality of ribbon guides 28 which are spaced apart so that the ribbon 18 assumes a generally rectangular configuration in a vertical plane across the web 12. Opposite ends of the ribbon are secured to a pair of adjoining ribbon spools 30 and 32 which alternately function for ribbon supply and accumulation. The spools are alternately driven in opposite directions by a spool control mechanism (not shown) the details of which form no part of the present invention. It will be appreciated that located between the operator and the print line on the paper web 12, that is, the section of the paper on which the type dies 26 are directed, is the carrier 24, the type dies 26, as well as the ribbon 18. Additionally, positioned between the operator and the paper is a portion of a printer frame support plate 34 which supports the ribbon accumulation and feed spools 30 and 32. These components obstruct with the operator's view of the print line, thus making it extremely difficult and awkward for the operator to accurately locate a selected type row on the paper at the print line of the printer. Such a situation is particularly objectionable when the operator wishes to make insertions into select locations of a form.

The drive mechanism for the web 12 includes an elongated splined drive shaft 36 which is journalled for rotation through a pair of plates 38 forming a portion of the main frame of the printer. The longitudinal axis of the splined drive shaft 36 is parallel to the plane of the web 12 and normal to the path of web movement. The drive shaft 36 passes through a pair of spaced tractors 40 and 42 and is manually driven by means of knurled web advance knob 44 secured to one end thereof adjacent the plate 38 of the main support frame. Additionally, the splined drive shaft 36 is automatically driven by a suitable motor, not shown, through gearing means 46. The drive tractors 40 and 42 which slidably move along the drive shaft 36 are also mounted on a slide tube 48 which is supported by a support rod 50. The axis of the rod 50 is parallel to the axis of the drive shaft 36 and to the plane of the web 12 and the ends of the rod 50 are secured to the plates 38. It will be appreciated that the rod 50, in conjunction with the splined drive shaft 36, provides a rail path upon which the tractors 40 and 42 ride. The drive tractors 40 and 42 serve to drivingly engage sprocket holes 52 located along the longitudinal edges of the paper web 12, thereby drawing the paper across the print mechanism 14. Each of the drive tractors 40 and 42 pivotably support tractor doors 54 and 56 respectively. The doors 54 and 56 are biased against the web 12 by means of an overcenter toggle mechanism including coil spring 58 and 60. Suitable drive tractors are described in U.S. Pat. No. 3,825,162 and entitled "Feed Mechanism" issued to Leo J. Hubbard on July 23, 1974.

The illustrated apparatus additionally includes type margin adjustment means 62 for shifting the slide tube 48 with respect to the support rod 50. In this manner, both tractors 40 and 42 are positioned in unison and the paper web 12 carried by the tractors is shifted with respect to the print mechanism 14 so as to effect accurate placement of the type margin upon the web 12. Additionally, means 64 for adjusting the drive to various form widths is included which varies the relative spacing of the tractors 40 and 42 and in this manner permits adaptation of the drive mechanism 14 to various paper web widths is accomplished. The illustrated adjustment means 62 and 64 are more fully described and illustrated in U.S. application Ser. No. 534,025 filed Dec. 18, 1974, now U.S. Pat. No. 3,941,288 issued Mar. 2, 1976, to R. R. Wanat and having a common assignee with this application.

Serving to bias the paper web 12 toward the tractors 40 and 42 and additionally provide a visible type position reference means, is a paper positioning rod 66. The rod 66 is supported from the side plates 38 by means of pivotally mounted positioning rod suspension arms 68. The axis of the paper positioning rod 66 is parallel to the web 12 as are both the axes of the splined drive shaft 36 and the tractor support rod 50 but located upon an opposite side of the web. Serving to facilitate positioning of a selected location on the web with respect to the print line of the print mechanism 14, is a print line reference clip 70 which is slidably mounted upon the tractor door 54 as will hereinafter be more thoroughly considered.

Figure 3:
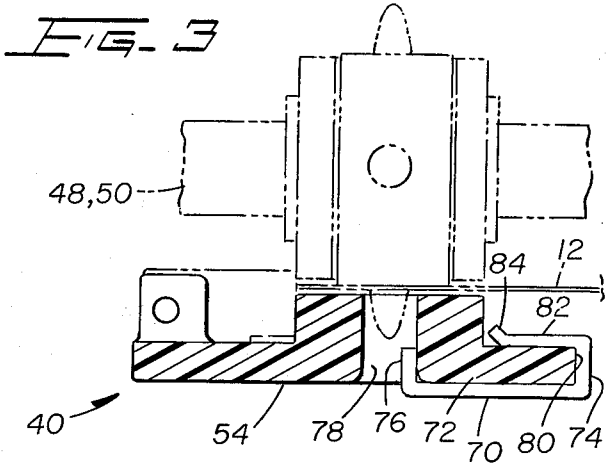
FIG. 3 is an enlarged sectional view of a portion of the illustrated apparatus taken along the line 3—3 of FIG. 2.
Figure 4:
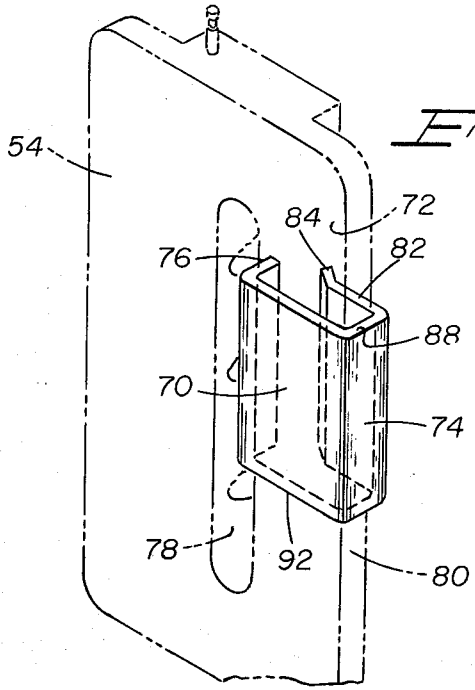
FIG. 4 is an enlarged prospective view of a component of the apparatus of FIG. 2 with certain portions of the printer shown in phantom for clarity of illustration.

As more clearly shown in FIG. 3, the door 54 defines an elongated opening adapted to allow a plurality of pull pins of the drive tractor to pass therethrough. The paper web is engaged with the pull pins and maintained in position by the door which is held against the paper by the tractor doors. As illustrated, the door 54 defines an enlarged flange 72. Slidably embracing the flange 72 is the print line reference clip 70. The print line reference clip includes a rectangularly shaped forward wall 74, having a major axis generally normal to the axis of the drive shaft 36. The height of the wall 74 is substantially equal to the distance from the top surface of the paper positioning rod 66 to the bottom of the print line of the type dies 26 in the carrier 24. The clip 70 defines a rearwardly projecting lip 76 which embraces the inner wall of an elongated opening 78 defined by the door 54 as well as an outwardly disposed side wall 80. The body of the clip 70 continues about the rear surface of the door 54 defining a rear binding wall 82 which tightly engages the rear surface of the door 54. To facilitate attachment of the clip 70 to the tractor door, an edge 84 of the rearwardly projecting wall of the print line reference clip is flared outwardly as illustrated in FIGS. 3 and 4. The clip 70 is preferably constructed of a resilient material such as plastic so that it may be easily attached to the door 54 during assembly. Thus, the clip 70, when positioned upon the door 54, will slide along an axis parallel to the axis on which the perforations 52 of the web 12 are located and thus normal to the type rows upon the paper web. As will be noted, the path of movement of the clip 70 is restricted by the length of the elongated opening 78 defined by the door 54.

Figure 2:
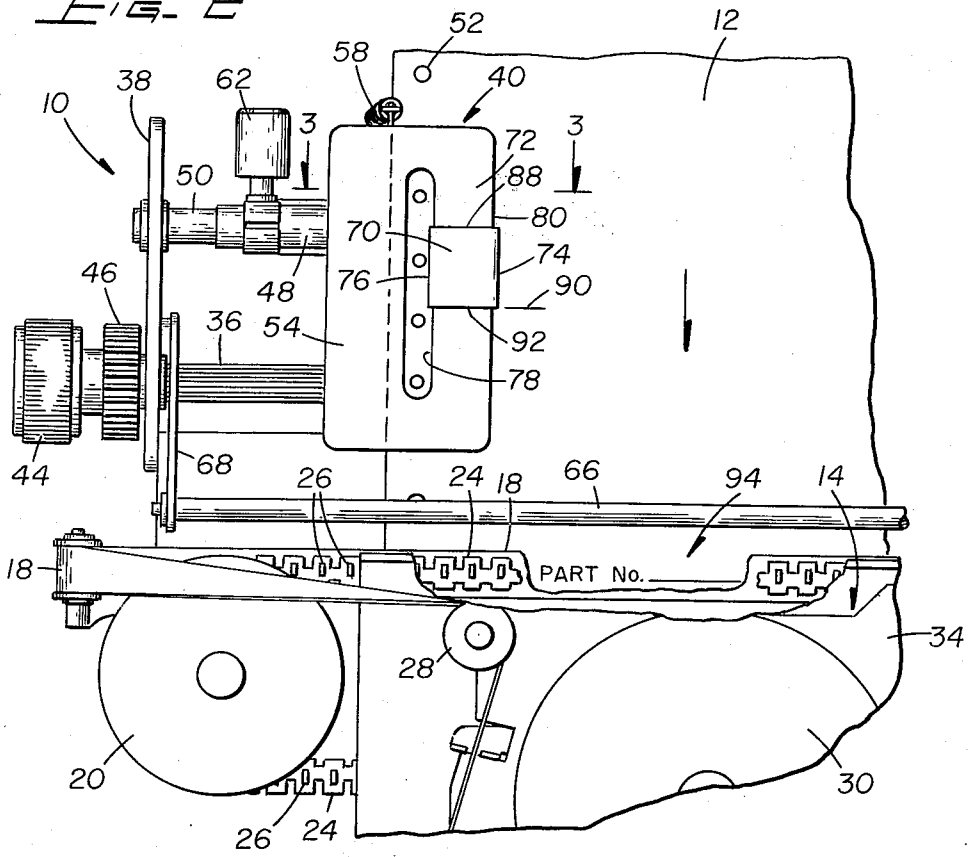
FIG. 2 is a fragmentary front plan view of the apparatus of FIG. 1 illustrating an alternate operational mode.

In use, the location on the web 12 upon which the type is to be directed is referenced with respect to the paper web positioning rod 66 by rotating the manual drive knob 44 so that the bottom of the selected type row is aligned with the upper edge of the paper positioning rod as illustrated at 86 in FIG. 1. Thereafter, the operator places a mark 90 upon the web 12 just opposite a top edge 88 of the front wall 74 of the print line reference clip 70. Alternately, the operator may slide the clip 70 upon the tractor door 54 until the upper edge is aligned with a selected reference indicia upon the web 12. The operator then rotates the manual advance knob 44 moving the web 12 until the reference mark 90 on the web 12, previously noted as being adjacent the upper edge 88 of the clip 70, is positioned adjacent a lower edge 92 of the clip 70 as ilustrated in FIG. 2.

As previously mentioned, the distance from the edge 92 of the front wall to the upper wall 88 is approximately the same as the distance from the top of the paper positioning rod 66 to the print line of the type mechanism 14. Thus, when the paper is rolled downwardly placing the reference mark 90 on the web 12 in alignment with the edge 92; the selected type row 86 will now be placed in line with the dies on the print line of the print mechanism 14 as at 94 of FIG. 2. In this manner, a selected type row is readily aligned with respect to the print mechanism 14 even through the print line of the apparatus is totally concealed from the operator's view. An apparatus has been described which serves to allow the operator to conveniently position a selected type row with respect to the print line of a printer.

Although the invention is shown and described with reference to a preferred embodiment thereof, it will be understood that various changes in form and detail may be made without departing from the spirit and scope of the invention.

What is claimed is:

1. A method for positioning a paper web with respect to the print line of a high speed printer comprising the steps of:

positioning the desired type row on the web in alignment with a reference indicator provided by the printer and spaced a preselected distance from the print line of the printer;

positioning a first reference location carried on the printer with respect to a selected mark on the web; and moving the web until said selected mark on the web is aligned with respect to a second location spaced from the first location by said preselected distance thereby locating the selected type row at the print line of the printer.

2. In combination with a high speed printer having facilities for selectively moving and positioning a web with respect to a type mechanism printing on the web along a print line, an apparatus for accurately locating a selected line of the web with respect to the type mechanism comprising:

means for defining a reference indicator spaced from the print line of the printer a preselected distance;

means for defining spaced first and second reference locations, the relative spacing of said first and second reference locations being substantially equivalent to the spacing between said reference indicator and the print line of the printer; said first and second reference location defining means being selectively movable with respect to said web along a line normal to the print line of the type mechanism thereby facilitating selective alignment of said first reference location with a preselected mark upon said web so that the successive alignment of said preselected mark upon the web with respect to said second reference location will cause that portion of the web aligned with said reference indicator to move into alignment with the type mechanism.

3. The apparatus of claim 2 wherein said first and second reference location defining means is a clip.

4. The apparatus of claim 3 wherein said clip is constructed of resilient material and shaaped to slidably embrace a component of the printer for movement therealong.

5. The apparatus of claim 4 wherein said first reference location is defined by a first edge of said clip and said second reference location is defined by a second edge of said clip, said first and second edges being in parallel orientation.

6. The apparatus of claim 4 wherein said printer component is a door of a web drive tractor, said clip being movable along a portion of said tractor door.

7. The apparatus of claim 6 wherein said first reference location is defined by a first edge of said clip and said second reference location is defined by a second edge of said clip, said first and second edges being in parallel orientation.

* * * * *